United States Patent [19]

Izumida et al.

[11] Patent Number: 4,622,491

[45] Date of Patent: Nov. 11, 1986

[54] ELECTRON GUN FOR COLOR PICTURE TUBE WITH ELECTROSTATIC FOCUSSING LENS

[75] Inventors: Yukihiro Izumida; Kazuo Majima, both of Mobara; Hidemasa Komoro, Chiba; Masakatsu Horiuchi; Mamoru Ikeda, both of Mobara, all of Japan

[73] Assignee: Hitachi, Ltd., Tokyo, Japan

[21] Appl. No.: 610,492

[22] Filed: May 15, 1984

[30] Foreign Application Priority Data

May 18, 1983 [JP] Japan ..... 58-85709

[51] Int. Cl.[4] ..... H01J 29/62

[52] U.S. Cl. ..... 313/414

[58] Field of Search ..... 313/414, 413, 412, 448, 313/449

[56] References Cited

U.S. PATENT DOCUMENTS 4,535,266 8/1985 Say ..... 313/414

FOREIGN PATENT DOCUMENTS 0082548 7/1981 Japan ..... 313/413

0068848 4/1983 Japan ..... 313/413

*Primary Examiner*—Palmer C. DeMeo

*Attorney, Agent, or Firm*—Antonelli, Terry & Wands

[57] ABSTRACT

An electron gun for color picture tube has a focusing electrode and an anode electrode respectively formed of an oval thick plate for forming main focusing lenses. Each of the focusing electrode and anode is formed with three electron beam passing holes arranged in line in a direction orthogonal to a tube axis of the picture tube. The focusing electrode and the anode are arranged to oppose each other with a distance therebetween such that their corresponding electron beam passing holes oppose each other. When predetermined voltages are applied to the focusing electrode and anode, main lenses are formed between the respective opposing holes. As viewed along the tube axis, the in line electron beam passing holes of each electrode include two outer electron beam passing holes each having an outer half in the form of a semi-circle and an inner half in the form of a semi-ellipse having a diameter of the semi-circle as its major axis and a central electron beam passing hole in the form of an ellipse having a major axis which is equal to the diameter of the semi-circle and which extends in a direction orthogonal to the direction of arrangement of the electron beam passing holes.

9 Claims, 10 Drawing Figures

ELECTRON GUN FOR COLOR PICTURE TUBE WITH ELECTROSTATIC FOCUSSING LENS

BACKGROUND OF THE INVENTION

This invention relates to electron guns for color picture tubes, and more particularly to an in-line type electron gun for a color picture tube in which the focusing characteristic is improved.

In general, the diameter of the main lens of the electron gun for a color picture tube affects its focusing characteristic to a great extent, and thus, in order to obtain a fine focusing characteristics, it is desirable to maximize the diameter of the main lens.

FIG. 1 is a longitudinal sectional view of a main part of one example of a prior art in-line type electron gun of a bipotential focusing system. Referring to FIG. 1, there are shown cathodes 1A, 1B and 1C for emitting three electron beams from their head surfaces, a control electrode 2 for controlling the amounts of the electron beams, an accelerating electrode 3 for accelerating the electron beams, and a lower focusing electrode 4 for focusing the electron beams. The control electrode 2, accelerating electrode 3 and lower focusing electrode 4 have sets of electron beam passing holes 2A, 2B and 2C, 3A, 3B and 3C and 4A, 4B and 4C for the three electron beams, respectively. In addition, there are shown an upper focusing electrode 5 having electron beam passing holes 5A, 5B and 5C, and an anode 6 having electron beam passing holes 6A, 6B and 6C. The three electron beam passing holes of each of the upper focusing electrode and anode are formed by a process of drawing and arranged in line to oppose to each other. When each of the anode 6 and upper focusing electrode 5 is applied with a predetermined potential, three main electrostatic focusing lenses (hereafter simply referred to as main lenses) for the three electron beams are established at the opposed electron beam passing holes. For example, the upper focussing electrode 5 and the anode 6 are applied with about 7,000 volts and 25,000 volts, respectively. The respective electrodes having the electron beam passing holes are made of thin plates by the process of drawing so as to form an oval cup shape, as shown in FIG. 1.

In the electron gun constructed as above, the three electron beams A, B and C, which are controlled in their amounts by the signal potentials applied to the three cathodes 1A, 1B and 1C, are slightly focused by prefocus lenses formed between the opposed holes of the accelerating electrode 3 and lower focusing electrode 4. Then, the electron beams are focused by the main lenses formed by the upper focusing electrode 5 and anode 6 so that beam spots are projected on a phosphor screen of the picture tube not shown. At the same time, the outer sides of electron beams A and C are tilted by an angle $\theta$ to the center beam by a known measure such that the electron beam passing holes 6A and 6C of the anode 6 are made slightly eccentric to the outside with respect to the electron beam passing holes 5A and 5C of the upper focusing electrode 5, so that the three electron beams A, B and C are converged at a point. Reference numeral 7 denotes a convergence electrode.

In the electron gun constructed as above, the beam spot size on the phosphor screen of picture tube affects sharpness of the picture and is therefore desired to be as small as possible. In general, the diameter of the main lens is increased for improving the focusing characteristic to this end.

FIG. 2 is a plan view showing a main part of the upper focusing electrode 5 as viewed from the anode 6. The surface of the anode 6 opposing the upper focusing electrode 5 also has an identical configuration. Referring to FIG. 2, the three electron beam passing holes 5A, 5B and 5C have a diameter D and are arranged in line to be separated by a center-to-center spacing S. In order to increase the diameters of the main lenses for the improvement of the focusing characteristic, it is necessary to increase the diameter D of the electron beam passing holes 5A, 5B and 5C. Since the electron beam passing holes 5A, 5B and 5C of the upper focusing electrode 5 are made of a non-magnetic metal plate in an about 0.3 mm thick, for example, stainless steel plate and formed by pressing, these holes must be subjected to drawing in order to improve the breakdown voltage characteristic between the focusing electrode 5 and the anode 6 shown in FIG. 1. Thus, edges of these holes can be rounded by drawing to advantageously suppress a tendency of discharge. Further, to prevent the deterioration of rotational symmetry of the main lens electric field due to a non-symmetrical shape of the oval cup shape electrode, the depth, l, for drawing is required to be $\frac{1}{2}$ or more of the diamater D of the hole. But, drawing the thin plate is so critical as to limit the diameter D to a dimension which is smaller than the center-to-center spacing S by 0.8 to 1.0 mm. the increase of the diameter D will therefore require increase of the spacing S. The increase of the spacing S will however result in large convergence error at each point of the phosphor screen upon operation of picture tube and in an increase of the dimension in the direction of the holes disposition, orthogonal to the tube axis, of the upper focusing electrode 5 and anode 6 which form the main lenses, so that they become close to the inner wall of the bulb neck within which the electron gun is placed, thus the breakdown voltage characteristic is deteriorated.

Further, in order to obtain a good focusing characteristic, it is the practice that the allowable deformity of a circle (major axis-minor axis) for the electron beam passing holes 5A, 5B and 5C is desired to be about 0.5% or less of the hole diameter D. Accordingly, in assembling the electron gun, the respective electrodes are supported by a tool (not shown) provided with three core stems passing through the respective electron beam passing holes, and heated multiform glass 8 (bead glass) are pressed against supporting members 9. In this case, in consideration of allowable production errors of the center-to-center spacing S and the hole diameter D in the respective electrodes, the three core steams are made thinner than the hole diameter D by about 0.02 to 0.03 mm. Consequently, stress generated by pressing the multiform glass 8 causes the respective cup-shaped electrodes with production errors to deform. The thus deformed upper focusing electrode affects the electron beam passing holes 5A, 5B and 5C formed by drawing, with the result that, in measurement of the electron gun after removing the same from the tool, out of roundness are about 0.05 mm in extremities, amounting to about 1.3% of the hole diameter D which is 3.9 mm, for example. With the drawn holes having worse roundness, the main lens electric fields are deformed to cause an astigmatic aberration in the electron beams, thereby giving rise to fatal deterioration of the focusing characteristic.

In order to extend the diameter of main lens, one of the inventors of the present invention, Yukihiro Izumida, has made a proposal in U.S. patent application Ser. No. 558,277 entitled "Electron Gun for Color Picture Tube" and filed on Dec. 5, 1983. According to this proposal, for the sake of maximizing the diameters of the main lenses within a limited range of the electrode dimension, the electron beam passing holes for forming the lenses are shaped into an oval hole having a major axis in a direction orthogonal to the direction in which the electron beam passing holes are arranged, and asymmetry of electric fields to the tube axis due to the oval holes is corrected by varying the distance between the opposed anode and upper focusing electrode, whereby a thin plate can be drawn to form the beam passing holes therein whose lengths in the major axes are equivalent to increased effective diameters of the lenses. However, such an electrode processed by drawing does not provide a solution of the probelm that the beam passing holes are deformed in production of the electron gun.

SUMMARY OF THE INVENTION

This invention has been achieved with a view of obviating the problems arising from the aforementioned proposal, and has for its object to provide an electron gun for a color picture tube in which the main lenses can be increased in their diameter without deteriorating the breakdown voltage characteristic and accuracies in assembling the electron gun can be improved to thereby improve focusing characteristics.

According to the present invention, there is provided an electron gun for a color picture tube including means for generating three electron beams along a tube axis of the picture tube; a first electrode having three electron beam passing holes arranged in line in a direction orthogonal to the tube axis; and a second electrode arranged to oppose the first electrode with a predetermined distance therebetween and having three electron beam passing holes arranged to oppose the electron beam passing holes of the first electrode. The first and second electrodes form main electrostatic forcusing lenses between the respective opposed electron beam passing holes of the first and second electrodes when applied with predetermined potentials, respectively. Each of the first and second electrodes is formed of an oval thick plate with the electron beam passing holes of each electrode arranged in the including two outer electron beam passing holes each having an outer half in the form of a semi-circle and a remaining half in the form of a semi-ellipse having a diameter of the semi-circle as its major axis, as viewed along the tube axis, and a central electron beam passing hole in the form of an ellipse having a major axis which is equal to the diameter of the semi-circle and which extends in a direction orthogonal to the direction of arrangement of the electron beam passing holes, as viewed along the tube axis. At least one of opposed surfaces of the first and second electrodes is formed with recesses between the center of each of the outer electron beam passing holes and the center of the central electron beam passing hole except for a peripheral edge of said surface, the recess having a predetermined depth, whereby the distance between the first and second electrodes at ends of the minor axis is wider than that distance at ends of the major axis of the elliptical portions of the electron beam passing holes.

BRIEF DESCRIPTION OF THE DRAWINGS

The present invention will be apparent from the following detailed description taken in conjunction with the accompanying drawings, in which.

DESCRIPTION OF THE PREFERRED EMBODIMENTS

Figure 1:
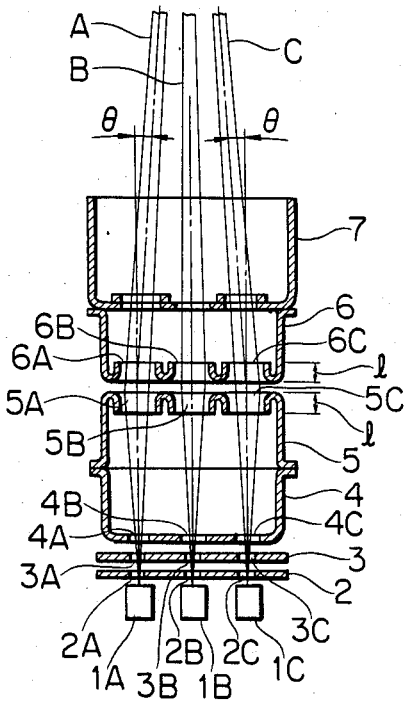
FIG. 1 PRIOR ART
FIG. 1 is a fragmentary longitudinal sectional view showing the structure of a prior art in-line type electron gun.
Figure 2:
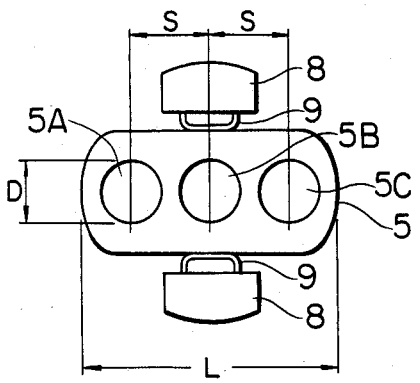
FIG. 2 PRIOR ART
FIG. 2 is a plan view showing an upper focusing electrode in the electron gun of FIG. 1.
Figure 3A:
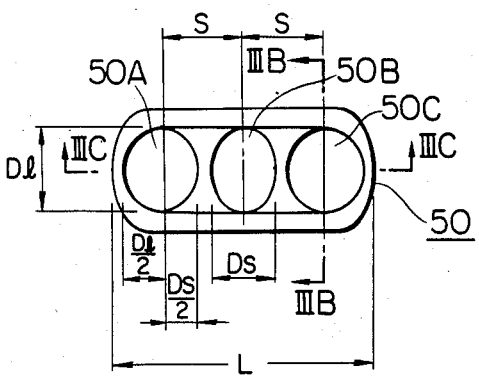
FIG. 3A is a plan view of an upper focusing electrode of an electron gun embodying the invention.
Figure 3B:
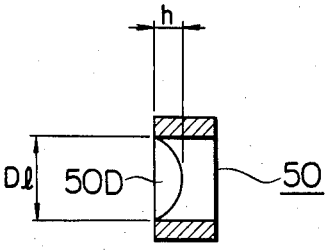
FIG. 3B is a sectional view taken on line IIIB—IIIB in the electrode of FIG. 3A.
Figure 3C:
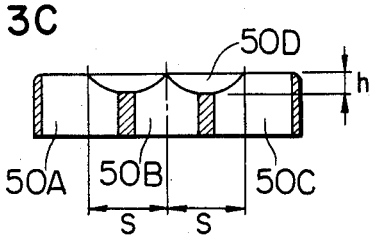
FIG. 3C is a sectional view taken on line IIIC—IIIC in the electrode of FIG. 3A.

FIG. 3A is a plan view showing a main part of an upper focusing electrode 50 of an electron gun for a color picture tube according to an embodiment of this invention. According to FIG. 3A, the upper focusing electrode 50 is not formed by drawing a thin plate according to the prior art example but is formed of a thick oval plate, for example, having a thickness of about 2 mm. Formed in the upper focusing electrode 50 are a central electron beam passing hole 50B (hereafter simply referred to as central hole) in the form of an elliptical hole having a major axis Dl and a minor axis Ds, and electron beam passing holes 50A and 50C on opposite sides of the central hole 50B (hereafter simply referred to as side or outer holes) each having outer and inner portions with respect to its center, the outer portion being in the form of a semi-circle which has a radius of Dl/2 and the inner portion being in the form of a semi-ellipse which is identical to a half of the central hole 50B and merges into the outer portion. The central and side holes 50A~50C are arranged in line to be separated by a center-to-center spacing S. While, in the prior art hole configuration as described previously with reference to FIG. 2, the diameter D is limited to the dimension which is smaller than the hole spacing S by 0.8 to 1.0 mm, the hole diameter is increased according to this invention in a direction orthogonal to the direction in which the holes are arranged, that is, in a vertical direction in FIG. 3A, so that the major axis Dl can be increased beyond the center-to-center spacing S. Further, being different from the prior art electrode formed by drawing the thin plate, the electrode according to this invention can be formed by pressing the oval thick plate. This permits fine working of the holes to ensure that the distance of a bridge between the central hole 50B and each of the side holes 50A and 50C as well as the distance between either edge of the electrode and each of the side holes 50A and 50C can be reduced to about 0.5 mm, and hence there is no need of increasing the horizontal dimension, L, for the sake of increasing the hole diameter. Incidentally, since the central hole 50B and the side holes 50A and 50C for forming the main lenses respectively take the form of the elliptical hole and the deformed circular holes each of which has the semi-circular portion and the semi-elliptical portion merging thereinto, the electron beams passing through these holes are intensively focused in the minor axes and subjected to astigmatic aberration. In other words, because of the non-true-circle of the holes, the lens electric fields can not be of rotational symmetry. In order to correct the asymmetry, a measure is applied to the central and side holes as shown in FIGS. 3B and 3C illustrating sections taken in FIG. 3A. More particularly, a recess 50D is formed in the wall facing with the anode between the center of the central hole 50B and the center of each of the side holes 50A and 50C. When sectioned along the major axis of the hole, the recess 50D takes the form of a semi-ellipse having a major diameter Dl and a minor radius h as shown in FIG. 3B. Because of the provision of the recess, the distance between the opposed anode and upper focusing electrode becomes wide at the bottom of the recess and narrow at the electrode major surface. As a result, the inter-electrode distance can be varied gradually along the periphery of elliptical holes. In other words, by the inter-electrode distance, the focusing action by the electric fields can be corrected so as to become uniform along the whole periphery of the holes.

Figure 4:
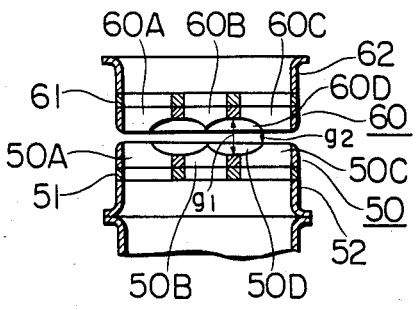
FIG. 4 is a frequentary longitudinal sectional view showing the electrode structure for forming main lenses in the electron gun according to this invention.

FIG. 4 shows, in sectional form, a main part of the electron gun wherein the upper focusing electrode 50 opposes the anode 60 having a similar construction to that of the electrode 50. Since recesses, having a semi-elliptical section as shown in FIG. 3B, are formed in the opposed major surfaces of the upper focusing electrode 50 and andoe 60, the distance between each of the holes 50A to 50C of the electrode 50 and each of the holes 60A to 60C of the anode 60 is such that the distance, $g_1$, at the ends of minor axis of the opposed elliptical holes is larger than the distance, $g_2$, at the ends of major axis thereof. By setting the depth h (minor radius) of the semi-elliptically sectioned recess to a proper value, the asymmetrical electric fields due to the deformed circular holes, such as an ellipse or a combination of a half-ellipse and a half-circle, can be corrected properly, so that the main lens electric fields through which the electron beams pass can be made rotationally symmetrical and equivalent diameters of the lenses equal the major axis Dl. Thus, it is possible to provide the electron beam passing holes having the effective diameter Dl which is larger than the diameter D of the holes according to the prior art, without increasing the hole spacing S.

Incidentally, when making an attempt to punch out with high accuracies the holes 50A to 50C in the oval thick plate of the upper focusing electrode 50 and the holes 60A to 60C in the oval thick plate of the anode 60, it is difficlut to use, in view of producitivity, a plate having a thickness of more than 2 mm from the standpoint of mass-production and the practical thickness of the plate to be used is limited to about 2 mm in the existing art of press working. Accordingly, if the plate thickness is set to 2 mm when the diameter of the electron beam passing hole is desired to be more than 4 mm, the aforementioned ratio between the hole depth and the hole diameter becomes below ½. Under this condition, due to the asymmetrical configuration of the electrode supporting member, an asymmetrical electric field will be produced. To overcome such a disadvantage, in the embodiment of FIG. 4 an auxiliary electrode 51 is provided to be attached on the upper focusing electrode 50. The auxiliary electrode 51 is made of a flat thick plate having an oval shape identical to the upper focusing electrode 50. The auxiliary electrode 51 also has beam passing holes corresponding to the holes 50A to 50C by punching but is not formed with any recess. Similarly, an auxiliary electrode 61 of an identical oval contour to the anode 60 is attached thereto. The auxiliary electrode 61 also has holes corresponding to the holes 60A to 60C by punching but is not formed with any recess. In addition, a supporting member 52 overlies the back of the auxiliary electrode 51 and a supporting member 62 overlies the back of the auxiliary electrode 61. This structure reinforces the mechanical strength of the electrodes for forming the main lenses to an extent that the shape of the holes will not deform under the application of stress generated by the pressing of the bead glass when assembling the electron gun.

Consequently, according to the construction of the present invention, the main lens diameter can be increased substantially and accuracy of assembling can be improved, thereby providing the electron gun which is highly improved in its focusing characteristic.

Figure 5:
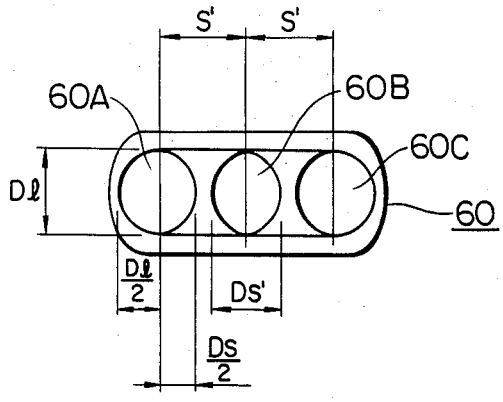
FIG. 5 is a plan view of an anode in FIG. 4.

The convergence for the outer side electron beams can be accomplished by making the hole spacings S' for the holes 60A, 60B and 60C of the anode 60 as shown in FIG. 5 larger than the hole spacings S of the upper focusing electrode 50 within a range of from 0.1 to 0.15 mm, for example. In this case, the main lens electric fields on the opposite sides are so deformed as to cause the opposite side electron beams A and C to become slightly elongated, as compared to the central electron beam B, in the major axis direction. In order to correct the shape of the side electron beams into a circular one, the minor diameter, Ds', of the central elliptical hole 60B is made slightly larger than the minor diameter Ds of the central elliptical hole 50B of the upper focusing electrode 50 to reduce the ellipticity (major axis/minor axis) of the central elliptical hole 60B, so that the major-axis elongation of the central electron beam B can be much the same as that of the opposite side electron beams A and C. Additionally, the depth h of the semi-elliptically sectioned recesses 50D and 60D for the upper focusing electrode 50 and anode 60 are slightly increased. With the above measures, the shape of the three electron beams can be corrected into a circular one.

Figure 6A:
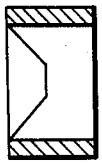
FIGS. 6A, 6B and 6C are sectional views of the electrode in FIG. 3B, showing modified contours of a recess.
Figure 6B:
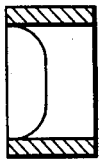
Figure 6C:
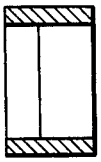

The recess in the electrode shown in FIG. 3B can be modified as shown in FIGS. 6A to 6C. More particularly, the sectioned profile of the recess is not limited to the semi-elliptical form as shown in FIG. 3B but the sectional contour of the recess 50D or 60D for the upper focusing electrode 50 or the anode 60 may be approximated by linear segments or by linear seqments and curved segments in combination for the sake of attaining the object of the present invention. Obviously, examples indicated herein are for illustration only and various modifications of the sectional contour may be conceivable by those skilled in the art in view of teachings of the present invention.

With the recent trend to reduce the diameter of the tube neck of a color picture tube aiming at reduction of deflection power consumption, the electron gun accommodated in the tube neck is reduced in size and consequently, the main lens diameter is also reduced, resulting in aggravation of the focusing characteristic. Under the circumstances, it has been earnestly desired to improve the focusing characteristic. For example, in color picture tubes presently on production, the neck diameter is about 22.5 mm, and the electron gun to be accommodated therein has main lenses as dimensioned by a center-to-center spacing S of 4.75 mm and a hole diameter of 3.9 mm. In contrast, according to the present invention, the main lenses were exemplarily dimensioned by the upper focusing electrode 50 having a hole spacing S of 4.75 mm, a major axis Dl of 50.0 mm, a minor diameter Ds of 4.0 mm and a recess depth h of 1.2 mm and the anode 60 having a hole spacing S' of 4.85 mm, a major diameter Dl of 5.0 mm, a minor diameter Ds' of 4.10 mm and a recess depth h of 1.2 mm, to thereby have an equivalent main lens diameter of 5.0 mm which is about 1.3 times the equivalent main lens diameter of the conventional electron gun. As a result, the focusing characteristic was improved according to the present invention to an extent which was comparable to that of a color picture tube having a large neck diameter of about 29 mm.

The upper focusing electrode 50 and the anode 60 made by press working are limited in thickness as described previously and an electrode plate formed with holes of large diameters is difficult to so form that its thickness is larger than about ½ of the hole diameter. However, a thick electrode part can readily be formed through powder metallurgical process wherein metal powders are compressed and thereafter sintered. For formation of the electrode 50 and andoe 60 through powder metallurgical process, metal powders of non-magnetic material such as stainless steel powders added with a binder such as acryl resin are molded by means of dies under compression, and a resulting mold is calcined at 600° to 700° C. in a vacuum or reducing atmosphere and then sintered at 1200° to 1300° C. in a vacuum or reducing atmosphere. A resulting product affected by sintering to slightly vary in dimension is shaped by means of finishing dies under compression. In this manner, a final product can be obtained with superior accuracies to the conventional thin plate electrode formed by pressing. By using the product, an electrode of the same structure as that described in connection with the foregoing embodiments of the present invention can be materialized to attain the object of the present invention.

While the bipotential focus type electron gun has been described in the foregoing embodiments, application of the invention is not limited thereto but the present invention may of cource be applied to the main lens forming electrodes of other unipotential-type or multifocus type electron guns with the same effect as above.

As described above, the electron gun for color picture tube according to the present invention can increase the main lens diameter by overcoming problems encountered in working the electrode and the restriction imposed on the breakdown voltage characteristic, thereby improving the focusing characteristic and providing pictures of high sharpness.

We claim:

1. An electron gun for a color picture tube comprising:

means for generating three electron beams along a tube axis of said picture tube;

a first electrode having three electron beam passing holes arranged in line in a direction orthogonal to said tube axis; and a second electrode arranged to oppose said first electrode with a predetermined distance therebetween and having three electron beam passing holes arranged to oppose said electron beam passing holes of said first electrode, said first and second electrodes forming main electrostatic focusing lenses between said respective opposed electron beam passing holes of said first and second electrodes when applied with predetermined potentials, respectively;

wherein each of said first and second electrodes is formed of an oval thick plate; said in line electron beam passing holes of each electrode including two side or outer electron beam passing holes each having an outer half in the form of a semi-circle and a remaining half in the form of a semi-ellipse having a diameter of said semi-circle as its major axis, as viewed along said tube axis, and a central electron beam passing hole in the form of an ellipse having a major axis which is equal to the diameter of said semi-circle and which extends in a direction orthogonal to the direction of arrangement of said electron beam passing holes, as viewed along said tube axis; and at least one of opposed surfaces of said first and second electrodes is formed with a recess between the center of each of said outer electron beam passing holes and the center of said central electron beam passing hole except for a peripheral edge of said surface, said recess having a predetermined depth whereby the distance between said first and second electrodes at ends of the minor axis is wider that that distance at ends of the major axis of the elliptical portions of said electron beam passing holes.

2. An electron gun according to claim 1, wherein said first and second electrodes are respectively attached, at their surfaces opposite to their opposing surfaces, to supporting members of a predetermined thickness in which holes having the same shapes as said electron beam passing holes are punched out.

3. An electron gun according to claim 1, wherein the ellipticity (major axis/minor axis) of said central electron beam passing hole in one of said first and second electrodes which is at higher potential is smaller than in the other electrode which is at lower potential.

4. An electron gun according to claim 2, wherein the ellipticity (major axis/minor axis) of said central electron beam passing hole in one of said first and second electrodes which is at higher potential is smaller than in the other electrode which is at lower potential.

5. An electron gun according to claim 1, wherein said recess has a semi-elliptical sectional contour taken along the major axis of said electron beam passing hole, said contour having a major axis equal to the major axis of said elliptical electron beam passing hole and a minor axis equal to said predetermined depth.

6. An electron gun according to claim 1, wherein said recess has a contour which is configured by linear segments or by a combination of linear segments and curved segments, so as to approximate a semi-elliptical curve..

7. An electron gun according to claim 2, wherein said recess has a contour which is configured by linear segments or by a combination of linear segments and curved segments, so as to approximate a semi-elliptical curve.

8. An electron gun according to claim 3, wherein said recess has a contour which is configured by linear segments or by a combination of linear segments and curved segments, so as to approximate a semi-elliptical curve.

9. An electron gun according to claim 1, wherein said oval thick plate of at least one of said first and second electrodes is made of metal power sintered mold.

* * * * *